US009754694B2

(12) United States Patent
Baurichter et al.

(10) Patent No.: US 9,754,694 B2
(45) Date of Patent: Sep. 5, 2017

(54) METHOD AND DEVICE FOR PRODUCING A $^{99m}$TC REACTION PRODUCT

(75) Inventors: Arnd Baurichter, Odense (DK); Oliver Heid, Erlangen (DE); Timothy Hughes, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 855 days.

(21) Appl. No.: 13/576,539

(22) PCT Filed: Jan. 26, 2011

(86) PCT No.: PCT/EP2011/051017

§ 371 (c)(1),
(2), (4) Date: Aug. 1, 2012

(87) PCT Pub. No.: WO2011/092174

PCT Pub. Date: Aug. 4, 2011

(65) Prior Publication Data

US 2012/0307954 A1 Dec. 6, 2012

(30) Foreign Application Priority Data

Feb. 1, 2010 (DE) ..... 10 2010 006 434

(51) Int. Cl.
*G21G 1/10* (2006.01)
*G21G 1/00* (2006.01)

(52) U.S. Cl.
CPC ..... *G21G 1/10* (2013.01); *G21G 1/001* (2013.01); *G21G 2001/0042* (2013.01)

(58) Field of Classification Search
CPC ... G21G 2001/0042; G21G 1/10; H05H 13/00
(Continued)

(56) References Cited

U.S. PATENT DOCUMENTS 4,123,498 A 10/1978 Rosenbaum et al. ..... 423/2
4,176,158 A * 11/1979 Laidler et al. ..... 423/2
(Continued)

FOREIGN PATENT DOCUMENTS

AU 3675278 A 1/1980 ..... G21G 1/04
AU 515808 B2 4/1981 ..... G21G 4/08
(Continued)

OTHER PUBLICATIONS

New World Encyclopedia (Sublimation Chemistry; URL http://www.newworldencyclopedia.org/entry/sublimation_(chemistry); 2008).*
(Continued)

*Primary Examiner* — Marshall O'Connor
(74) *Attorney, Agent, or Firm* — Slayden Grubert Beard PLLC

(57) ABSTRACT

A method for producing a reaction product containing $^{99m}$TC may include providing $^{100}$Mo-metal targets to be irradiated, irradiating the $^{100}$Mo-metal target with a proton stream having an energy for the induction of a $^{100}$Mo(p, 2n)$^{99m}$TC core reaction, heating the $^{100}$Mo-metal target to over 300° C., recovering incurred $^{99m}$Tc in a sublimation-extraction process with the aid of oxygen gas which is conducted over the $^{100}$ Mo-metal target forming $^{99m}$Tc-Technetium oxide. Further, a device for producing the reaction product containing $^{99m}$Tc may include a $^{100}$Mo metal target, an acceleration unit for providing a proton stream, which can be directed to the $^{100}$Mo-Metal target, such that a $^{100}$Mo(p, 2n)$^{99m}$TC core reaction is induced upon irradiation of the $^{100}$Mo-metal target by the proton stream, a gas supply line for conducting oxygen gas onto the irradiated $^{100}$Mo-metal target to form $^{99m}$TC-Technetium oxide, and a gas discharge line to discharge the sublimated $^{99m}$TC-Technetium oxide.

24 Claims, 5 Drawing Sheets

(58) Field of Classification Search
USPC ..... 315/502, 505, 506; 313/62, 359.1; 376/185, 186, 194, 197, 198
See application file for complete search history.

(56) References Cited

U.S. PATENT DOCUMENTS

| | | | | |
|---|---|---|---|---|
| 5,116,470 | A | 5/1992 | Mausner et al. | 204/157.21 |
| 5,784,423 | A | 7/1998 | Lidsky et al. | 376/156 |
| 5,802,438 | A | 9/1998 | Bennett et al. | 423/2 |
| 5,802,439 | A | 9/1998 | Bennett et al. | 423/2 |
| 5,874,811 | A * | 2/1999 | Finlan et al. | 315/502 |
| 6,011,825 | A | 1/2000 | Welch et al. | 376/195 |
| 7,020,287 | B2 | 3/2006 | Unger | 380/277 |
| 2007/0160176 | A1 | 7/2007 | Wada | 376/158 |
| 2012/0307954 | A1 | 12/2012 | Baurichter et al. | 376/195 |

FOREIGN PATENT DOCUMENTS

| | | | | |
|---|---|---|---|---|
| EP | 0776595 | B1 | 12/1998 | G21G 1/10 |
| HU | 37359 | A2 | 12/1985 | B01D 59/04 |
| HU | 196913 | B | 2/1989 | B01D 59/04 |
| HU | 53668 | A1 | 11/1990 | C01G 99/00 |
| JP | 479548 | Y1 | 4/1972 | B23K 35/00 |
| JP | 53112398 | A | 9/1978 | B01D 7/00 |
| JP | 2003213404 | A | 7/2003 | C23C 14/24 |
| JP | 2010223937 | A | 10/2010 | G21G 1/06 |
| JP | 4709548 | B2 | 6/2011 | G06F 21/00 |
| JP | 4872599 | B2 | 2/2012 | H04B 17/00 |
| WO | 2011/092174 | A1 | 8/2011 | G21G 1/00 |

OTHER PUBLICATIONS

Chinese Office Action, Application No. 201180007946.5, 14 pages, May 7, 2014.
Lagunas-Solar, M.C., "Accelerator Production of $^{99m}$Tc with Proton Beams and Enriched $^{100}$Mo Targets," Nr. IAEA-TECDOC-1065, 26 pages, Jan. 1999.
German Office Action, Application No. 10 2010 006 434.3-54, 2 pages, Nov. 16, 2010.
International Search Report and Written Opinion, Application No. PCT/EP2011/051017, 16 pages, Apr. 8, 2011.
Beaver, J.E. et al., "Production of $^{99M}$Tc on a Medical Cyclotron: A Feasibility Study," The Journal of Nuclear Medicine, vol. 12, No. 11, 4 pages, Jun. 9, 1971.
Russian Office Action, Application No. 2012137215, 11 pages, Jul. 14, 2015.
Russian Office Action, Application No. 2012137215, 6 pages, Apr. 13, 2015.

* cited by examiner

METHOD AND DEVICE FOR PRODUCING A $^{99m}$TC REACTION PRODUCT

CROSS-REFERENCE TO RELATED APPLICATIONS

This application is a U.S. National Stage Application of International Application No. PCT/EP2011/051017 filed Jan. 26, 2011, which designates the United States of America, and claims priority to DE Patent Application No. 10 2010 006 434.3 filed Feb. 1, 2010. The contents of which are hereby incorporated by reference in their entirety.

TECHNICAL FIELD

This disclosure relates to a method and a device for producing a $^{99m}$Tc reaction product. $^{99m}$Tc is used in medical imaging in particular, for example in SPECT imaging.

BACKGROUND

A commercially available $^{99m}$Tc-generator is an instrument for extracting the metastable isotope $^{99m}$Tc from a source containing decaying $^{99}$Mo, for example with the aid of solvent extraction or chromatography.

$^{99}$Mo in turn is usually obtained from a method which uses highly enriched uranium $^{235}$U as a target. $^{99}$Mo is created as a fission product by irradiating the target with neutrons. However, as a result of international treaties, it will become ever more difficult in future to operate reactors with highly enriched uranium, which could lead to a bottleneck in the supply of radionuclides for SPECT imaging.

U.S. Pat. No. 5,802,438 discloses a method for producing $^{99m}$Tc by irradiating a Mo-metal target in the surroundings of a reactor. HU 53668 (A3) and HU 37359 (A2) describe methods in which $^{99m}$Tc is obtained with the aid of sublimation processes.

SUMMARY

In one embodiment, a method for producing a reaction product containing $^{99m}$Tc may comprise: providing a $^{100}$Mo-metal target to be irradiated, irradiating the $^{100}$Mo-metal target with a proton beam having an energy suitable for inducing a $^{100}$Mo(p, 2n)$^{99m}$Tc nuclear reaction, heating the $^{100}$Mo-metal target to a temperature of over 300° C., and obtaining the $^{99m}$Tc made in the $^{100}$Mo-metal target in a sublimation-extraction process with the aid of oxygen gas, which is routed over the $^{100}$Mo-metal target forming $^{99m}$Tc-technetium oxide in the process.

In a further embodiment, the method further comprises feeding the obtained $^{99m}$Tc-technetium oxide to an alkaline solution, more particularly to a sodium hydroxide solution, or to a salt solution to form $^{99m}$Tc-pertechnetate. In a further embodiment, the $^{100}$Mo-metal target is available in the form of a film, in the form of a powder, in the form of tubules, in the form of a grid structure, in the form of spheres or in the form of metal foam. In a further embodiment, the $^{100}$Mo-metal target is held by a thermally insulating mount. In a further embodiment, heating of the $^{100}$Mo-metal target is achieved by the irradiation by the proton beam. In a further embodiment, the heating is brought about with the aid of current conducted through the $^{100}$Mo-metal target. In a further embodiment, the heating is brought about by heating a chamber, more particularly a ceramic chamber, in which the $^{100}$Mo-metal target is arranged.

In another embodiment, a device for producing a reaction product containing $^{99m}$Tc may comprise: a $^{100}$Mo-metal target, an accelerator unit for providing a proton beam which can be directed at the $^{100}$Mo-metal target, the proton beam having an energy which is suitable for inducing a $^{100}$Mo(p, 2n)$^{99m}$Tc nuclear reaction when the $^{100}$Mo-metal target is irradiated by the proton beam, a gas supply line for routing oxygen gas onto the irradiated $^{100}$Mo-metal target for forming $^{99m}$Tc-technetium oxide, and a gas discharge line for discharging the sublimated $^{99m}$Tc-technetium oxide.

In a further embodiment, the device may further comprise a liquid chamber with an alkaline solution, more particularly with a sodium hydroxide solution, or a salt solution into which the $^{99m}$Tc-technetium oxide can be routed for the formation of $^{99m}$Tc-pertechnetate. In a further embodiment, the $^{100}$Mo-metal target is available in the form of a film, in the form of a powder, in the form of tubules, in the form of a grid structure, in the form of spheres or in the form of metal foam. In a further embodiment, the $^{100}$Mo-metal target is held by a thermally insulating mount. In a further embodiment, the device includes a circuit for conducting current through the $^{100}$Mo-metal target. In a further embodiment, the $^{100}$Mo-metal target is arranged in a heatable chamber, more particularly a ceramic chamber.

BRIEF DESCRIPTION OF THE DRAWINGS

Example embodiments will be explained in more detail below with reference to figures, in which.

DETAILED DESCRIPTION

Figure 1:
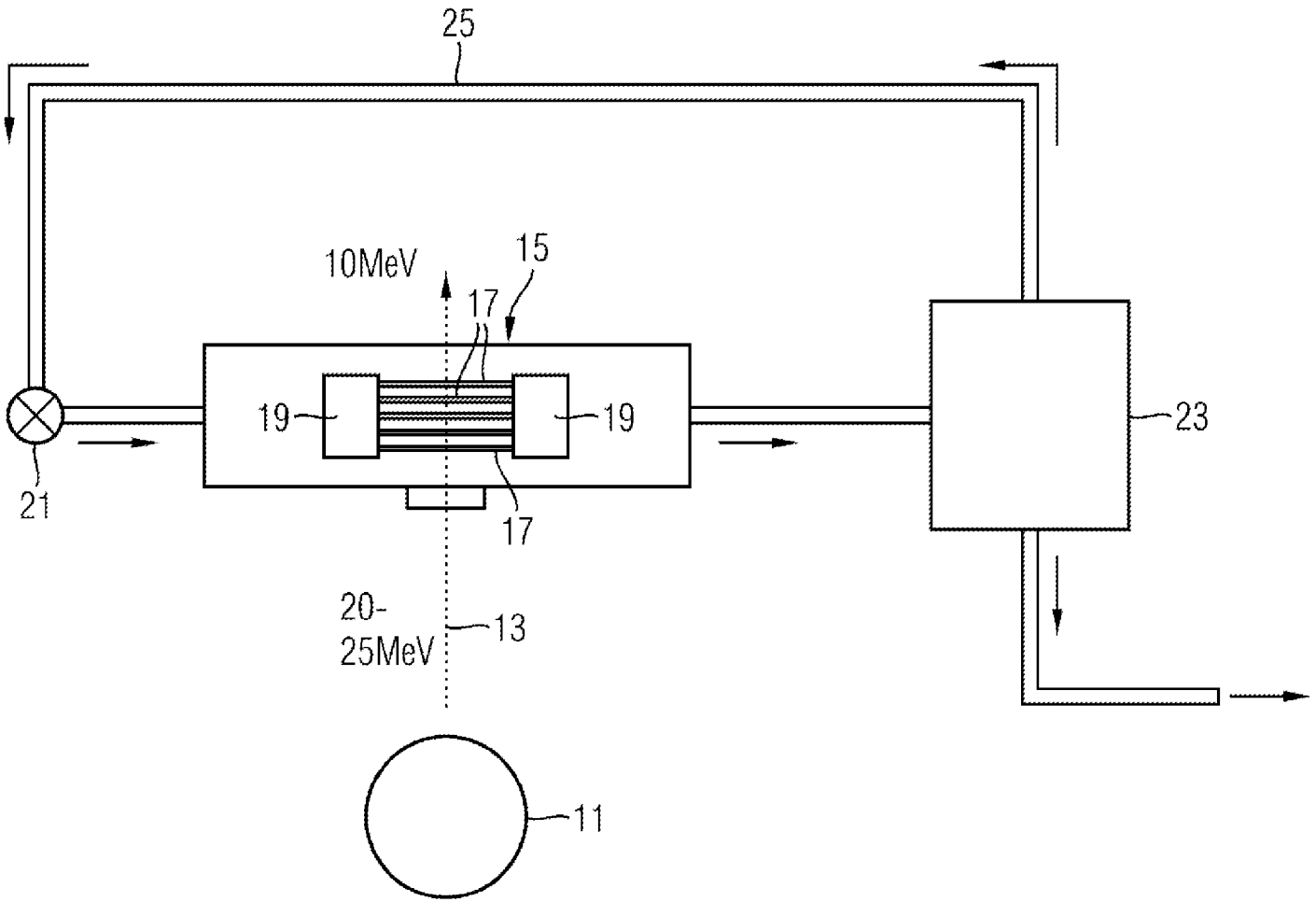
FIG. 1 shows an example device for producing $^{99m}$Tc-pertechnetate, according to one embodiment.

Some embodiments provide a method and a device by means of which a reaction product containing $^{99m}$Tc can be obtained.

In some embodiments, a method for producing a reaction product containing $^{99m}$Tc may comprise the following steps:

- providing a $^{100}$Mo-metal target to be irradiated,
- irradiating the $^{100}$Mo-metal target with a proton beam having an energy suitable for inducing a $^{100}$Mo(p, 2n)$^{99m}$Tc nuclear reaction, with a $^{100}$Mo(p, 2n)$^{99m}$Tc nuclear reaction being induced by the irradiation,
- heating the $^{100}$Mo-metal target to a temperature of over 300° C., more particularly of over 400° C.,
- obtaining the $^{99m}$Tc made in the $^{100}$Mo-metal target in a sublimation-extraction process with the aid of oxygen gas, which is routed over the heated $^{100}$Mo-metal target forming $^{99m}$Tc-technetium oxide in the process.

The $^{99m}$Tc-technetium oxide can be discharged by the gas flow of the oxygen gas and thus be e.g. transported away from the $^{100}$Mo-metal target.

Certain embodiments are based on the discovery that $^{99m}$Tc can be obtained directly in a $^{100}$Mo-metal target if the $^{100}$Mo-metal target is irradiated by a proton beam with a suitable energy, e.g. in a region between 20 MeV and 25 MeV. Thus, the $^{99m}$Tc is obtained directly from a nuclear reaction occurring as a result of the interaction of the proton beam with the molybdenum atoms, according to the nuclear reaction $^{100}$Mo(p, 2n)$^{99m}$Tc.

The $^{99m}$Tc produced in this manner is extracted with the aid of a sublimation process. To this end, the $^{100}$Mo-metal target with the $^{99m}$Tc is heated to a temperature of over 300° C. If oxygen gas is now routed to the $^{100}$Mo-metal target, the $^{99m}$Tc reacts with the oxygen, forming $^{99m}$Tc-technetium oxide in the process, e.g. according to the equation $2Tc+3.5O_2 \rightarrow Tc_2O_7$. The molybdenum of the target likewise reacts with the oxygen, forming a molybdenum oxide in the process, e.g. by forming $MoO_3$. However, since the molybdenum oxide is substantially less volatile than the technetium oxide, the technetium oxide is transported away by the oxygen gas routed over the $^{100}$Mo-metal target and can be discharged.

Here, the proton irradiation and the extraction of $^{99m}$Tc by the oxygen gas with optional heating of the $^{100}$Mo-metal target can occur at the same time or alternately in succession.

Accelerating protons to the aforementioned energy usually requires only a single accelerator unit of average size, which can also be installed and used locally. Using the above-described method, $^{99m}$Tc can be made locally in the vicinity or in the surroundings of the desired location of use, for example in the surroundings of a hospital. In contrast to conventional, non-local production methods which are accompanied by the use of large installations such as in nuclear reactors and the distribution problems connected therewith, a local production solves many problems. Nuclear medicine units can plan their workflows independently from one another and are not reliant on complex logistics and infrastructure.

The proton beam may be accelerated to an energy of between 20 MeV and 25 MeV. Restricting the maximum energy to no more than 35 MeV, more particularly to 30 MeV and most particularly to 25 MeV, avoids too high an energy of the particle beam triggering nuclear reactions which lead to undesired reaction products, e.g. other Tc isotopes than $^{99m}$Tc, which should then be removed again in a complicated manner.

The $^{100}$Mo-metal target can be designed in such a way that the emerging particle beam has an energy of at least 5 MeV, more particularly at least 10 MeV. This makes it possible to keep the energy range of the proton beam in a region in which the occurring nuclear reactions remain controllable and in which undesired reaction products are minimized.

In one embodiment, the following step is additionally carried out:

feeding the obtained $^{99m}$Tc-technetium oxide, which was transported away, to an alkaline solution, more particularly to a sodium hydroxide solution, or to a salt solution, more particularly a sodium salt solution, to form $^{99m}$Tc-pertechnetate.

This may provide an advantageous reaction product containing $^{99m}$Tc because $^{99m}$Tc-pertechnetate can easily be distributed and processed and can be a starting point for the production of radiopharmaceuticals, e.g. SPECT tracers.

In the case of a sodium hydroxide solution, the reaction equation is: $Tc_2O_7+2NaOH \rightarrow 2NaTcO_4+H_2O$.

Excess $O_2$, which originates from the oxygen gas and was routed through the liquid, can be cleaned and returned to the gas supply, e.g. within a closed loop.

In one embodiment, the $^{100}$Mo-metal target is available in the form of a film, more particularly as a stack of films of a plurality of films arranged one behind the other in the beam direction. This makes it possible to obtain $^{99m}$Tc in a particularly effective fashion and, moreover, it is easier to heat the $^{100}$Mo-metal target to the temperature required for sublimation. Alternative forms are possible, for example, the $^{100}$Mo-metal target can be available in the form of a powder, in the form of tubules, in the form of a grid structure, in the form of spheres or in the form of metal foam.

To this end, the $^{100}$Mo-metal target can be held by a thermally insulating mount, e.g. epoxy resin strengthened by G20.

Heating to the desired temperature can already be achieved by proton beam irradiation because the proton beam on its part transfers thermal energy onto the $^{100}$Mo-metal target. Optionally, the temperature of the $^{100}$Mo-metal target can be set by matching the energy and/or intensity of the proton beam and/or the strength of the gas flow, which can e.g. be controlled by a valve, to one another or by controlling one or more of these variables. Heat supply by the proton beam and heat dissipation by the mount and by convection cooling can thus be matched to one another. This enables the equilibrium temperature to be set in the $^{100}$Mo-metal target.

In particular, the $^{100}$Mo-metal target can be heated by proton beam irradiation only. Additional heating devices are not mandatory.

In an alternative and/or additional embodiment, the $^{100}$Mo-metal target can be heated with the aid of a current which is conducted through the $^{100}$Mo-metal target, i.e. it can be heated with the aid of a circuit, e.g. by the Ohmic heating occurring in this case. The temperature to be achieved can be set in a simple manner by controlling the electric circuit.

In an alternative and/or additional embodiment, the $^{100}$Mo-metal target can be arranged in a chamber, e.g. in a ceramic chamber, which is heated specifically for heating the $^{100}$Mo-metal target. This can also be used to reach or set the temperature required for the sublimation.

In some embodiments a device for producing a reaction product containing $^{99m}$Tc may comprise:

a $^{100}$Mo-metal target, an accelerator unit for providing a proton beam which can be directed at the $^{100}$Mo-metal target, the proton beam having an energy which is suitable for inducing a $^{100}$Mo(p, 2n)$^{99m}$Tc nuclear reaction when the $^{100}$Mo-metal target (15) is irradiated by the proton beam (13), a gas supply line for routing oxygen gas onto the irradiated $^{100}$Mo-metal target for forming $^{99m}$Tc-technetium oxide, a gas discharge line for discharging the sublimated $^{99m}$Tc-technetium oxide.

In one embodiment, the device can furthermore comprise:

a liquid chamber with an alkaline solution, more particularly with a sodium hydroxide solution, or a salt solution into which the $^{99m}$Tc-technetium oxide can be routed for the formation of $^{99m}$Tc-pertechnetate.

The device can furthermore comprise a heating device for heating the $^{100}$Mo-metal target to a temperature of over 400° C.

FIG. 1 shows one embodiment of a device for producing $^{99m}$Tc-pertechnetate.

An accelerator unit 11, e.g. a cyclotron, accelerates protons to an energy of approximately 20 MeV to 25 MeV. The protons are then, in the form of a proton beam 13, directed at a $^{100}$Mo-metal target 15, which is irradiated by the proton beam. The $^{100}$Mo-metal target 15 is designed such that the emerging particle beam has an energy of approximately at least 10 MeV.

Figure 4:
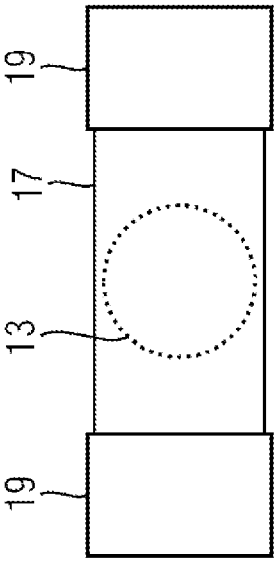
FIG. 4 shows a plan view of the $^{100}$Mo-metal film.

Illustrated here is a $^{100}$Mo-metal target 15 in the form of a plurality of metal films 17, arranged one behind the other in the beam direction and arranged perpendicular to the beam propagation direction. As illustrated in FIG. 4, the area of the film 17 is greater than the cross-sectional profile of the proton beam 13.

The metal films 17 are held by a thermally insulating mount 19 which, for example, can be manufactured in large parts from epoxy resin strengthened by G20.

The proton beam 13 interacts with the $^{100}$Mo-metal target 15 as per the $^{100}$Mo(p, 2n)$^{99m}$Tc nuclear reaction, from which $^{99m}$Tc then emerges directly.

Here, the proton beam 13 is controlled in terms of its intensity such that so much thermal energy is transferred to the metal films 17 during the irradiation that the metal films 17 moreover heat up to a temperature of over 400° C.

Oxygen gas is routed over the $^{99m}$Tc from an oxygen source via a valve 21 which controls the gas flow.

At such temperatures, the $^{99m}$Tc made in the metal films 17 reacts with the oxygen and makes $^{99m}$Tc-technetium oxide, e.g. according to the equation $2Tc+3.5O_2 \rightarrow Tc_2O_7$. The $^{100}$Mo likewise reacts with the oxygen forming a molybdenum oxide in the process, e.g. forming $^{100}MoO_3$. Since the $MoO_3$ is significantly less volatile than the technetium oxide, the technetium oxide is transported away by the oxygen gas routed over the $^{100}$Mo-metal target 15 and can be discharged.

The gas flow, the energy transmitted by the proton beam 13 and the heat loss through the mount 19 of the $^{100}$Mo-metal target 15 are matched to one another such that the temperature required for the sublimation-extraction process is reached and maintained.

The gas containing technetium oxide is subsequently routed into a liquid column 23 containing a salt solution or alkaline solution and effervesced there such that $^{99m}$Tc-pertechnetate is formed by a reaction of the technetium oxide with the solution, e.g. sodium pertechnetate in the case of a sodium hydroxide solution or a sodium salt solution. In the case of a sodium hydroxide solution, the reaction equation can, for example, be: $Tc_2O_7+2\ NaOH \rightarrow 2NaTcO_4+H_2O$.

Subsequently, the $^{99m}$Tc-pertechnetate now made can be used as starting point for the production of radiopharmaceuticals, e.g. of SPECT tracers.

The $O_2$ rising in the liquid column 23 can be routed back to the supplying gas inlet in an e.g. closed loop 25.

Figure 2:
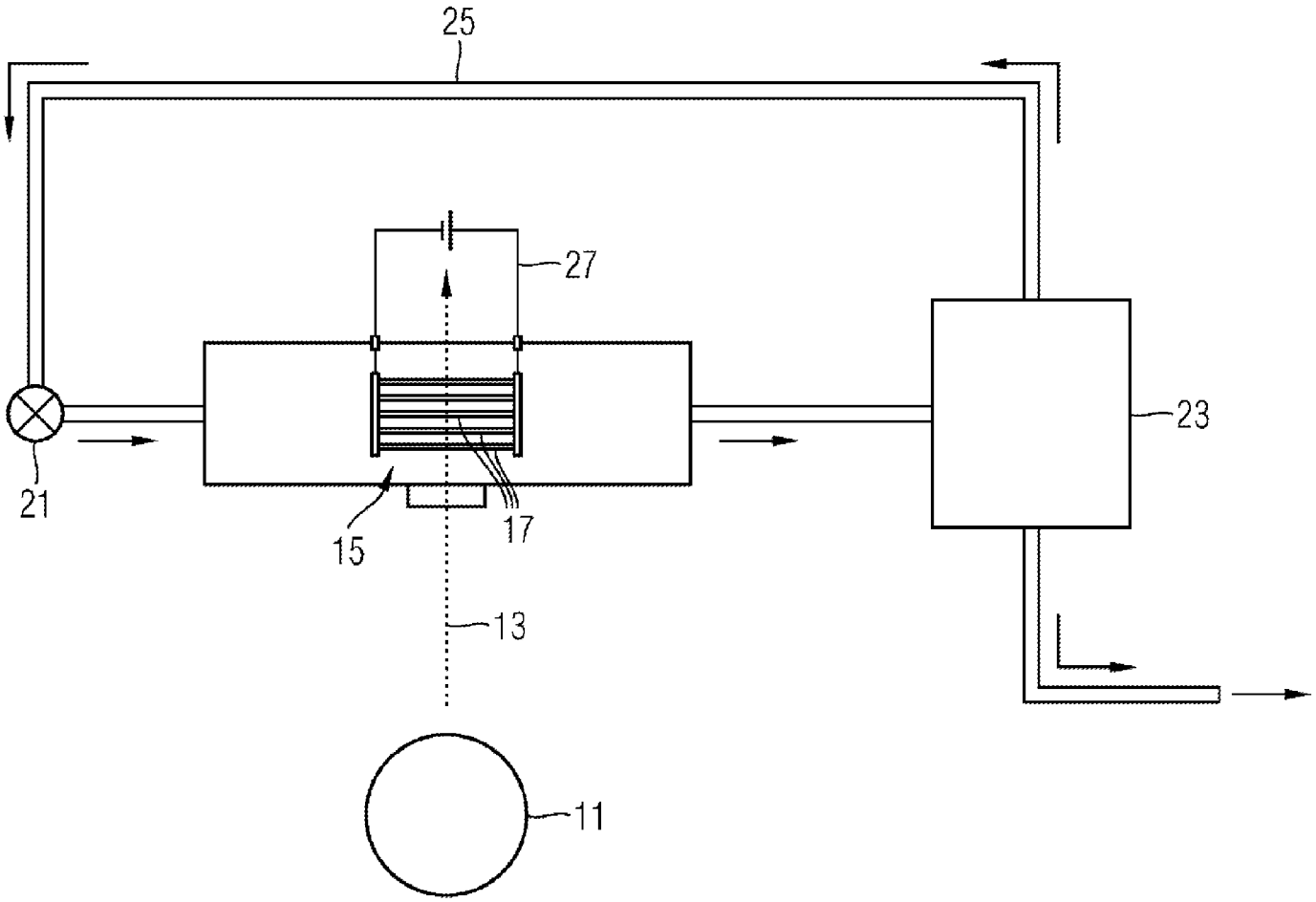
FIG. 2 shows another example device for producing $^{99m}$Tc-pertechnetate, according to another embodiment.

FIG. 2 shows another embodiment that substantially corresponds to the embodiment shown in FIG. 1.

This embodiment has a device 27, by means of which electric current can be conducted through the metal films 17, i.e. the metal films 17 are part of a circuit. The current which flows through the metal films 17 heats the metal films 17 by resistance heating. The temperature to which the metal films 17 are heated can thus be controlled in a simple manner, and so the metal films 17 reach a temperature required for the sublimation-extraction process.

Figure 3:
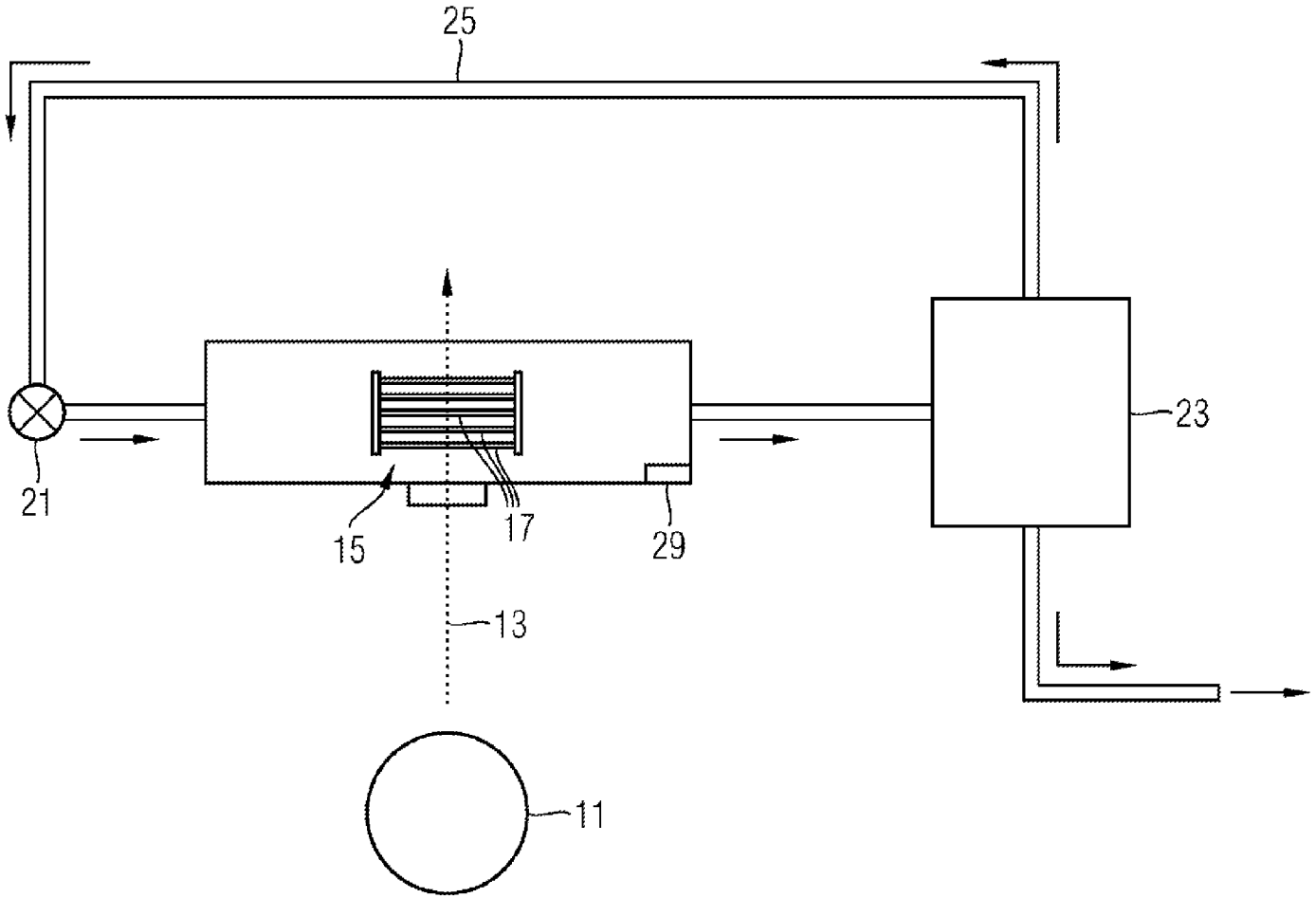
FIG. 3 shows another example device for producing $^{99m}$Tc-pertechnetate, according to another embodiment.

FIG. 3 shows a further embodiment, in which, compared to the embodiment shown in FIG. 1, a heating device 29 is arranged in the irradiation chamber, the latter being able to be made of e.g. ceramics, by means of which heating device the temperature required for the sublimation-extraction process is produced.

Embodiments shown in FIG. 1 to FIG. 3 for heating the metal films 17 can also be combined with one another.

In FIGS. 1-3, the $^{100}$Mo-metal target is embodied as metal film. Other embodiments are possible, e.g., as shown in FIGS. 5-9.

Figure 5:
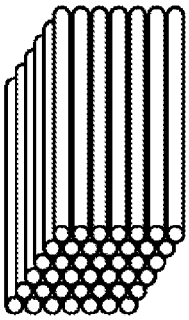

In FIG. 5, the $^{100}$Mo-metal target is embodied as a multiplicity of tubules.

Figure 6:
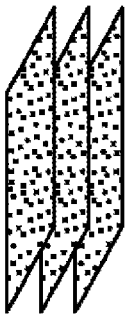
FIGS. 5-9 show the schematic representation of a $^{100}$Mo-metal target in different embodiments.

In FIG. 6, the $^{100}$Mo-metal target is available in powder form.

Figure 7:
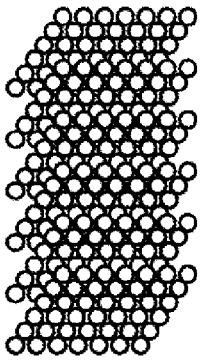

In FIG. 7, the $^{100}$Mo-metal target is shown as a multiplicity of spheres.

Figure 8:
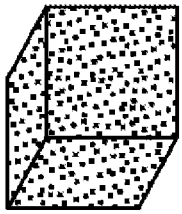

In FIG. 8, the $^{100}$Mo-metal target is shown in the form of a metal foam block.

Figure 9:
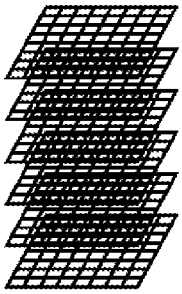

In FIG. 9, the $^{100}$Mo-metal target is shown in the form of a grid.

What is common to all these embodiments is that the $^{100}$Mo-metal target 15 has a large surface area, which can react with the supplied oxygen gas. This leads to an efficient extraction of the $^{99m}$Tc-technetium oxide.

Figure 10:
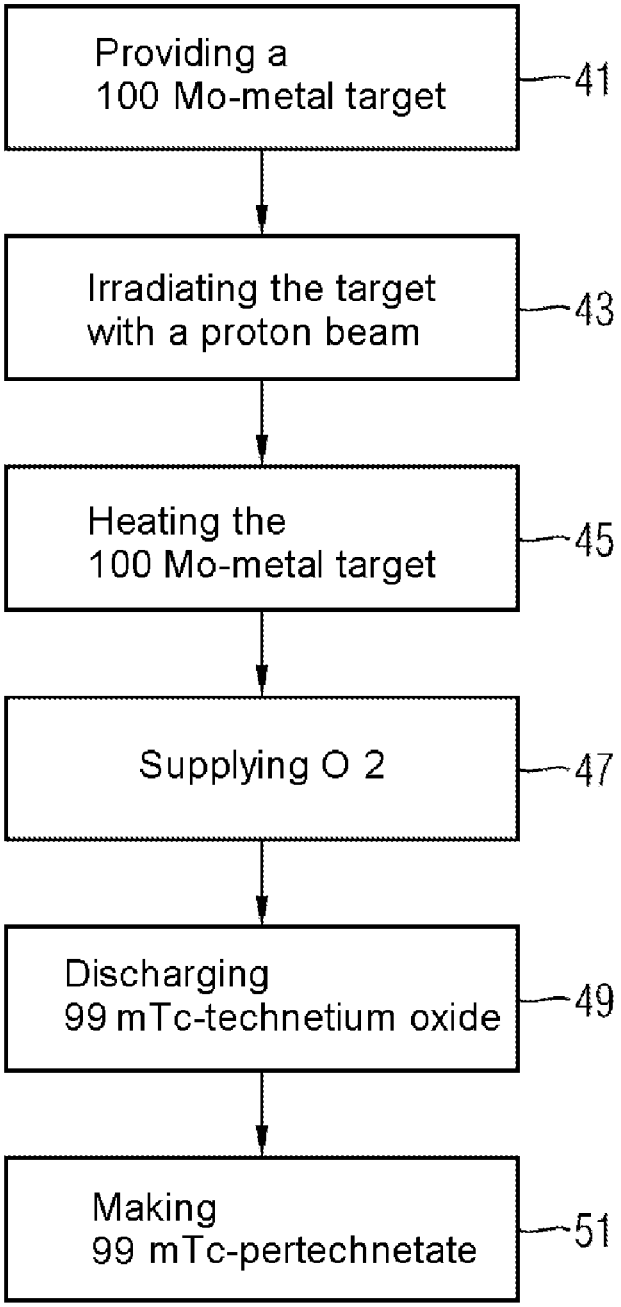
FIG. 10 shows steps of an example method, according to one embodiment.

FIG. 10 shows a schematic diagram of example steps of a method according to one embodiment.

Initially, a $^{100}$Mo-metal target is provided (step 41).

The target is subsequently irradiated by a proton beam which was accelerated to an energy of 10 MeV to approximately 25 MeV (step 43).

After irradiation of the target, the target is heated to a temperature of over 400° C. (step 45) in order, with the aid of a sublimation-extraction process, to extract the $^{99m}$Tc made in the target.

To this end, oxygen gas is routed over the target (step 47), the forming $^{99m}$Tc-technetium oxide being sublimated and discharged (step 49).

$^{99m}$Tc-pertechnetate can be obtained from the $^{99m}$Tc-technetium oxide with the aid of a sodium hydroxide solution or a sodium salt solution (step 51).

LIST OF REFERENCE SIGNS

11 Accelerator unit
13 Proton beam
15 $^{100}$Mo-metal target
17 Metal film
19 Mount
21 Valve
23 Liquid column
25 Loop
27 Circuit
29 Heating device
Step 41
Step 43
Step 45
Step 47
Step 49
Step 51

What is claimed is:

1. A method for producing a reaction product containing $^{99m}$Tc, comprising:

providing a $^{100}$Mo-metal target to be irradiated, accelerating protons with only a single acceleration unit to form a proton beam having an energy suitable for inducing a $^{100}$Mo(p, 2n)$^{99m}$Tc nuclear reaction, irradiating the $^{100}$Mo-metal target with the proton beam having the energy suitable for inducing the $^{100}$Mo(p, 2n)$^{99m}$Tc nuclear reaction, heating the $^{100}$Mo-metal target to a temperature of over 300° C., and obtaining the $^{99m}$Tc made in the $^{100}$Mo-metal target in a sublimation-extraction process with the aid of oxygen gas, which is routed over the $^{100}$Mo-metal target forming $^{99m}$Tc-technetium oxide in the process.

2. The method of claim 1, additionally comprising feeding the obtained $^{99m}$Tc-technetium oxide to an alkaline solution to form $^{99m}$Tc-pertechnetate.

3. The method of claim 1, wherein the $^{100}$Mo-metal target is in the form of a film, in the form of a powder, in the form of tubules, in the form of a grid structure, in the form of spheres, or in the form of metal foam.

4. The method of claim 1, wherein the $^{100}$Mo-metal target is held by a thermally insulating mount.

5. The method of claim 1, wherein heating of the $^{100}$Mo-metal target is achieved by the irradiation by the proton beam.

6. The method of claim 1, wherein the heating is achieved by conducting current through the $^{100}$Mo-metal target.

7. The method of claim 1, wherein the heating is achieved by heating a chamber in which the $^{100}$Mo-metal target is arranged.

8. A device for producing a reaction product containing $^{99m}$Tc, comprising:

a $^{100}$Mo-metal target, a single accelerator unit for accelerating protons, with only the single acceleration unit, to form a proton beam directed at the $^{100}$Mo-metal target to thereby irradiate the $^{100}$Mo-metal target, the proton beam having an energy which is suitable for inducing a $^{100}$Mo(p, 2n)$^{99m}$Tc nuclear reaction when the $^{100}$Mo-metal target is irradiated by the proton beam, wherein the device is configured to heat the $^{100}$Mo-metal target to a temperature of over 300° C., and a sublimation-extraction system for extracting $^{99m}$Tc, including:

a gas supply line for routing oxygen gas onto the irradiated and heated $^{100}$Mo-metal target forming $^{99m}$Tc-technetium oxide by sublimation, and a gas discharge line for extracting the sublimated $^{99m}$Tc-technetium oxide.

9. The device of claim 8, further comprising a liquid chamber with an alkaline solution into which the $^{99m}$Tc-technetium oxide is routed for the formation of $^{99m}$Tc-pertechnetate.

10. The device of claim 8, wherein the $^{100}$Mo-metal target is available in the form of a film, in the form of a powder, in the form of tubules, in the form of a grid structure, in the form of spheres or in the form of metal foam.

11. The device of claim 8, wherein the $^{100}$Mo-metal target is held by a thermally insulating mount.

12. The device of claim 8, comprising a circuit for conducting current through the $^{100}$Mo-metal target to heat the $^{100}$Mo-metal target to the temperature of over 300° C.

13. The device of claim 8, wherein the $^{100}$Mo-metal target is arranged in a heatable chamber to heat the $^{100}$Mo-metal target to the temperature of over 300° C.

14. The method of claim 1, additionally comprising feeding the obtained $^{99m}$Tc-technetium oxide to a sodium hydroxide solution.

15. The device of claim 8, further comprising a liquid chamber with a sodium hydroxide solution into which the $^{99m}$Tc-technetium oxide is routed for the formation of $^{99m}$Tc-pertechnetate.

16. The method of claim 1, additionally comprising feeding the obtained $^{99m}$Tc-technetium oxide to a salt solution to form $^{99m}$Tc-pertechnetate.

17. The device of claim 8, further comprising a liquid chamber with a salt solution into which the $^{99m}$Tc-technetium oxide is routed for the formation of $^{99m}$Tc-pertechnetate.

18. A method for producing a reaction product containing $^{99m}$Tc, comprising:

providing a $^{100}$Mo-metal target to be irradiated, accelerating protons in an acceleration unit to form a proton beam, irradiating the $^{100}$Mo-metal target with the proton beam having an energy suitable for inducing a $^{100}$Mo(p, 2n)$^{99m}$Tc nuclear reaction, heating the $^{100}$Mo-metal target, by the irradiation by the proton beam, to a temperature of over 300° C., and obtaining the $^{99m}$Tc made in the $^{100}$Mo-metal target in a sublimation-extraction process with the aid of oxygen gas, which is routed over the $^{100}$Mo-metal target, heated to the temperature over 300° C., forming $^{99m}$Tc-technetium oxide in the process.

19. The method of claim 18, comprising forming the proton beam with a single acceleration unit.

20. The method of claim 18, further comprising feeding the formed $^{99m}$Tc-technetium oxide to an alkaline solution to form $^{99m}$Tc-pertechnetate.

21. The method of claim 18, further comprising feeding the formed $^{99m}$Tc-technetium oxide to a salt solution to form $^{99m}$Tc-pertechnetate.

22. The method of claim 18, wherein the $^{100}$Mo-metal target comprises a film in the form of: a powder, tubules, a grid structure, spheres, or a metal foam.

23. The method of claim 18, comprising holding the $^{100}$Mo-metal target with a thermally insulating mount.

24. The device of claim 8, wherein the $^{100}$Mo-metal target is heated to the temperature over 300° C. by the irradiation of the proton beam from the single accelerator unit.

* * * * *